United States Patent [19]

Schmolka

[11] 4,321,167

[45] * Mar. 23, 1982

[54] HEAVY DUTY LIQUID DETERGENT COMPOSITIONS CONTAINING ALKOXYLATED ALKYLENE DIAMINES AND FATTY ACIDS

[75] Inventor: Irving R. Schmolka, Grosse Ile, Mich.

[73] Assignee: BASF Wyandotte Corporation, Wyandotte, Mich.

[ * ] Notice: The portion of the term of this patent subsequent to Apr. 21, 1998, has been disclaimed.

[21] Appl. No.: 215,952

[22] Filed: Dec. 12, 1980

Related U.S. Application Data

[63] Continuation-in-part of Ser. No. 65,320, Aug. 9, 1979, Pat. No. 4,263,179.

[51] Int. Cl.[3] ..... C11D 3/30

[52] U.S. Cl. ..... 252/548; 252/DIG. 14

[58] Field of Search ..... 252/548, DIG. 14

[56] References Cited

U.S. PATENT DOCUMENTS

| | | | |
|---|---|---|---|
| 2,843,509 | 7/1958 | Arden | 252/548 X |
| 2,914,482 | 11/1959 | Kopp | 252/548 |
| 2,992,995 | 7/1961 | Arden | 252/548 |
| 3,398,097 | 8/1968 | Kersnar et al. | 252/548 |
| 3,806,460 | 4/1974 | Mukai et al. | 252/DIG. 14 X |
| 3,869,399 | 3/1975 | Collins | 252/548 X |
| 4,079,078 | 3/1978 | Collins | 252/548 X |
| 4,105,592 | 8/1978 | Collins | 252/545 |
| 4,263,179 | 4/1981 | Schmolica | 252/548 |

*Primary Examiner*—P. E. Willis, Jr.

*Attorney, Agent, or Firm*—David L. Hedden; Joseph D. Michaels

[57] ABSTRACT

Liquid detergent compositions which are free of phosphate builders and nitrosamine-forming triethanolamines previously used with approximately 9 to 15 percent of N,N,N′,N′-tetrakis(2-hydroxypropyl)ethylene diamine or its equivalent.

4 Claims, No Drawings

HEAVY DUTY LIQUID DETERGENT COMPOSITIONS CONTAINING ALKOXYLATED ALKYLENE DIAMINES AND FATTY ACIDS

CROSS-REFERENCE TO RELATED APPLICATION

This application is a continuation-in-part of our copending application Ser. No. 65,320 filed Aug. 9, 1979 now U.S. Pat. No. 4,263,179.

BACKGROUND OF THE INVENTION

1. Field of the Invention

This invention relates to heavy-duty liquid detergent compositions, and in particular, to ones which are laundry detergents and ones which are designed so that they avoid the use of triethanolamine, a builder or alkalizing agent hitherto often considered especially useful and preferred in the making of compositions of the kind indicated above.

2. Description of the Prior Art

U.S. Pat. No. 4,079,078 may be taken as rather typical or prior-art teachings with respect to the making of a phosphate-free liquid laundry detergent composition. According to this patent, the use of triethanolamine is preferred.

U.S. Pat. No. 4,105,592 also relates to liquid detergent compositions, and it states that the use of excess free alkanolamine is considered desirable.

U.S. Pat. No. 3,456,176 relates to the making of liquid detergent compositions, and it says that in its final step of raising the pH of the composition to a value greater than 8.5, virtually any basic material capable of being used to reach that pH may be used. U.S. Pat. No. 3,395,215 contains a similar teaching to the effect that virtually any basic compound, preferably triethanolamine, may be used to neutralize a composition of this sort. U.S. Pat. No. 3,395,215 also indicates that there may be added to its composition a humectant, e.g., sorbitol.

U.S. Pat. No. 2,697,118 relates to N,N,N',N'-tetrakis(2-hydroxypropyl)ethylene diamine and similar compounds, and it teaches that such compounds are high-boiling bases and are valuable humectants.

A discussion of the problem of nitrosamines and how they have been found to be carcinogenic and undesirable in consumer products is found in the article of M. L. Douglass et al., "Chemistry of Nitrosamine Formation, Inhibition and Destruction", in Vol. 29 of the *Journal of the Society of Cosmetic Chemists,* pages 581 to 605 (September 1978).

To the inventor's knowledge, the prior art has been silent on the issues of (a) whether the above-indicated totally hydroxyalkylated alkylene diamines do, in fact, form nitrosamines in detectable amounts and (b) whether, in the liquid-laundry-detergent field, satisfactory performance results can be obtained when such totally hydroxyalkylated alkylene diamines are substituted for triethanolamine.

SUMMARY OF THE INVENTION

In the making of heavy-duty liquid detergent compositions, it has been found that when a totally hydroxyalkylated alkylene diamine such as N,N,N',N'-tetrakis(2-hydroxypropyl)ethylene diamine, used in some amount such as 9 to 15 percent, is substituted for triethanolamine, there is obtained a material having satisfactory performance characteristics, and the use of the particular alkylene diamines specified in accordance with this invention makes it possible to avoid the development of detectable amounts of nitrosamines in the products made with their use. Moreover, the building action of such amines is sufficiently great that phosphate-free liquid laundry detergents of satisfactory performance characteristics may be made with their use.

DESCRIPTION OF THE PREFERRED EMBODIMENTS

The novel liquid detergent compositions according to the present invention consist essentially of, as necessary ingredients, surfactants, suitable totally hydroxyalkylated alkylene diamine, and water. The compositions may also contain various optional ingredients, such as saturated and unsaturated fatty acids, solvents, hydrotroping agents, fabric brighteners, dyes, preservatives, perfumes, pigments, soil anti-redeposition agents, opacifiers, abrasives, suds builders, suds supressants, etc. The above-indicated optional ingredients are considered as not importantly affecting the ability of compounds formulated in accordance with the present invention, i.e., ones containing suitable surfactants and suitable totally oxyalkylated alkylene diamines, to yield the desired result, i.e., a suitably performing phosphate-free liquid laundry detergent which does not form nitrosamines in detectable amounts.

The organic surfactants which can be used in accordance with the invention include various nonionic, anionic, amphoteric and/or zwitterionic surfactants singly or in combination. These include various alpha-olefin sulfonates, fatty alcohol sulfates, fatty alcohol ether sulfates, n-alkylphenol ethoxylates, dialkylphenol ethoxylates, fatty amine ethoxylates, fatty alcohol alkoxylates, fatty alkanolamides, fatty amine oxides, etc. A useful listing of the various commercially available surfactant compositions is contained in McCutcheon's "Detergents and Emulsifiers", and in principle, the particular detergent compositions contained in the examples presented herein below may be modified by the substitution for the particular surfactants named therein of any of the other surfactants indicated in the above-mentioned work.

The compositions of the present invention contain, as an essential ingredient, one or more compounds which answer to the description that they are totally alkoxylated alkylene diamines, and in particular, they are most usually diamines which have been alkoxylated with propylene oxide and/or a higher alkylene oxide, i.e., one containing 4 or more carbon atoms. In most instances, the use of N,N,N',N'-tetrakis(2-hydroxypropyl-)ethylene diamine is preferred. The compound just named may, however, be replaced by its analog that is made by the addition of 4 moles of 1,2-butylene oxide to ethylene diamine, or by the product formed from the addition of 2 moles of propylene oxide and 2 moles of butylene oxide to ethylene diamine. When similar results can be obtained if the ethylene diamine or other alkylene diamine is oxyalkylated with a mixture of propylene oxide or other, higher oxide and ethylene oxide, or with ethylene oxide alone, such a practice is to be considered within the scope of the present invention. Moreover, the initiator does not need to be ethylene diamine; other alpha-omega diamines such as propylene, butylene, or other higher alpha-omega diamines may likewise be used, although ordinarily the initiator will be one that contains not more than 6 carbon atoms.

The surfactants usually comprise approximately 40 to 55 percent by weight of the composition. Satisfactory results have been obtained by using approximately 8 to 18 percent of anionic surfactant, such as a 60 percent-active aqueous solution of linear alkyl sulfonate, and approximately 32 to 40 percent of nonionic surfactant(s), such as a mixture of oxyalkylated fatty alcohols.

The totally oxyalkylated alkylene diamine may be present in an alkalizing amount of approximately 9 to 15 percent by weight of the composition. The use of N,N,N',N'-tetrakis(2-hydroxypropyl)ethylene diamine at a value in the range just indicated is predicated, as those skilled in the art will appreciate, upon the assumption that the remainder of the detergent composition is substantially neutral. The composition will be otherwise substantially neutral if the anionic surfactant (linear alkyl sulfonate) is used in its sodium-neutralized form, rather than in a free-acid form; the possibility exists that the anionic surfactant will be used in its free-acid form, and the N,N,N', N'-tetrakis(2-hydroxypropyl)ethylene diamine will also be used, in suitably greater corresponding amount, to serve not only as alkalizing agent but also as neutralizer for the free acid. Accordingly, it is proper to speak of detergent compositions which contain an alkalizing proportion of oxyalkylated alkylene diamine of 9 to 15 weight percent of such oxyalkylated alkylene diamine, thereby allowing for the possibility that such alkylene diamine may be present in greater quantities, for its alkalizing effect, if an anionic surfactant in the free-acid form is utilized.

Water is present in the compositions according to the invention in an amount of approximately 28 to 42 percent. If necessary or desired, a part of the water, such as up to about 10 percent, may be replaced with other solvent material such as ethyl alcohol, isopropyl alcohol, or the like, in order to obtain desired viscosity characteristics and/or solubilizing or compatibilizing effects. A part of the water may also be replaced by one or more of the various above-mentioned ingredients.

If a fatty acid is used, it would preferably be oleic acid, lauric acid, isostearic acid, or a similar straight chain or branched chain fatty acid which, when neutralized by the alkanolamine of the present invention, forms a soap which can contribute to the soil removal properties of the finished products. The fatty acids are used in an amount of approximately 0.1 weight percent to 5 weight percent, preferably from 1 weight percent to 2 weight percent, based on 100 parts of total composition.

Those skilled in the art require no instruction in respect to the matter of how the above-indicated ingredients are to be mixed to obtain a desired liquid laundry composition. In general, it can be stated that it may be necessary to mix one or more of the optional ingredients which is of difficult solubility or compatibility with another ingredient in which it is particularly soluble or compatible, before proceeding with the introduction of it into the desired final composition, but those skilled in the art are in general aware of the practices which are necessary and/or desirable in this regard.

The detergent compositions in accordance with the present invention are characterized by the absence of phosphate builder ingredients, and therefore, the compositions of the present invention have the advantage that they may be marketed and used without having such activity come into conflict with laws and regulations designed to protect the environment from damage caused by the use of phosphate-containing detergents.

In determining the usefulness of a detergent composition, it is customary to conduct tests in which fabric samples containing both unsoiled portions and portions provided with a standard soil are laundered in a test solution containing a suitable proportion, such as 0.1 percent or 0.2 percent, of the laundry detergent composition and at a suitable temperature of the washing liquid, such as 120° F. (49° C.). The effect on both cotton and cotton-polyester blends is usually investigated. There is usually reported a value for "soil removal" and a value for "whiteness retention".

Test Procedures and Materials

In all test procedures, the fabrics employed were 100 percent cotton and a cotton-polyester blend (36/65 cotton/dacron). Demineralized water was used for the preparation of solutions and for rinsing. All washing was performed at 60° C. (140° F.), with detergents at a total concentration of 0.25 percent (w/v).

Tagged Clay Soil Redeposition

Preparation of the tagged clay soil has been described in detail in a previous publication, namely, the article by J. W. Hensley and C. G. Inks entitled "Calcium-45-Tagged Clay as Detergency Test Soil", Symposim on Applied Radiation and Radiosotope Test Methods, *Special Technical Publication No.* 268, published by the American Society for Testing Materials, 1959. Briefly, tagging of the montmorillonite-type clay is done by exchange through treatment with radiocalcium chloride solution, and the tag is fixed by firing to 1000° C. The tagged clay is ground with water and washed to remove any loose calcium-45. After drying, it is then ground for a prolonged period with base stock lubricating oil. The resulting dispersion is diluted with heptanol and applied to cloth discs by pipet. The heptanol is allowed to evaporate before the soil is used. The soiling level is on the order of 0.5 mg. of clay per square inch.

Washing was done with a Mini-Washer, a machine designed primarily for use with radioactive soils. It has four small glass wash-vessels, which are shaken vertically in a constant-temperature bath, normally at 900 cycles per minute with a ¼-inch stroke. Two cloth discs, each about 38 millimeters in diameter, one soiled and one clean, are washed in each vessel in 7 milliliters of solution, along with 10 stainless steel balls. With ten-minute wash periods, soil-removal level has been found to be comparable to that obtained with a home washing machine using the normal wash cycle. Solution-to-cloth ratio is about 20:1, which is fairly close to ratios employed in practice. Washed discs are hand-rinsed in three portions of water. Radioactivity measurements are performed with automatic counting equipment employing an end-window gas flow counter. For counting, cloth discs are mounted on cardboard discs coated with rubber cement.

From the percent soil removal, as determined from initial and final counts on each soiled disc, the soil loading of the detergent bath is determined. Soil redeposition, as indicated by counts per minute on the initially clean disc, is corrected to an arbitrary standard soil level in the solution, assuming redeposition to be a linear function of soil in the bath. From the corrected soil redeposition values, whiteness retention values (inversely proportional to soil redeposition) are calculated as percent of a reference detergent. Details of the calculation and experimental justification for this method of correcting soil redeposition of differences in soil removal by different detergents have been published in the Hensley et al. article mentioned above.

In one aspect, the significance of the present invention is not limited to the laundry-detergent field; there exist other detergents, such as heavy-duty wall-cleaning detergents, in which it has hitherto been usual to use triethanolamine or the like for its alkalizing effect, and in accordance with the particular aspect to the invention here under discussion, there may be provided, in view of the discovery that N,N,N',N'-tetrakis(2-hydroxypropyl)ethylene diamine does not form nitrosamines, other heavy-duty detergent compositions which contain an alkalizing amount of 9 to 15 percent of such oxyalkylated alkylene diamine. Such other heavy-duty detergent compositions may contain minor amounts of abrasives.

When compositions in accordance with the invention are made which are intended to contain mirror amounts of fine abrasives, there may be used an abrasive material which may be selected from one of the well-known insoluble materials commonly used for such purpose, such as silica, calcium carbonate, zirconium oxide, etc. Preferably, only those materials with a Mohs hardness of less than 4 should be used to prepare products in this category, but harder abrasives can be used if care is taken to limit the particle size. Calcite, i.e., finely divided calcium carbonate, is preferred. It may be used in some suitable amount, such as approximately 2 to 40 percent, preferably 5 to 15 percent by weight.

An understanding of the invention may be aided by consideration of the following specific examples, which are intended as illustrative and not in a limiting sense.

EXAMPLE 1

There is made a liquid laundry detergent consisting essentially of 12.0 weight percent of N,N,N',N'-tetrakis(2-hydroxypropyl)ethylene diamine, 13.0 weight percent of a 60 percent-active solution of linear sodium alkyl sulfonate, 10.0 weight percent of nonionic surfactant material based upon straight-chain alcohols containing 12 to 15 carbon atoms and oxyethylated to an average molecular weight of 350, 25.0 weight percent of a nonionic surfactant material based upon straight-chain alcohols containing 12 to 15 carbon atoms and oxyethylated to an average molecular weight of 600, and 40 percent by weight of water.

Such a composition was subjected to testing to determine the presence of nitrosamines, and none was detected. In contrast, in the testing of similar but known, commercially available liquid laundry detergents based upon the use of triethanolamine, such testing invariably shows the presence of nitrosamines in detectable amount.

The above-indicated composition was also subjected to detergency testing, using a solution using 0.2 weight percent of the composition of Example 1 in tap water at 120° F., and using both dacron/cotton and mercerized cotton fabric samples. The results of such testing are presented in the following table.

| | Detergency Evaluation at 0.2% in Tap Water at 120° F. | | | |
|---|---|---|---|---|
| | Dacron/Cotton | | Mercerized Cotton | |
| | Soil Removal | W.R. | Soil Removal | W.R. |
| Example I | 105 | 79 | 111 | 94 |
| Commercially available | | | | |

-continued

| | Detergency Evaluation at 0.2% in Tap Water at 120° F. | | | |
|---|---|---|---|---|
| | Dacron/Cotton | | Mercerized Cotton | |
| | Soil Removal | W.R. | Soil Removal | W.R. |
| liquid detergent | 101 | 61 | 106 | 78 |

The above-indicated results demonstrate that the phosphate-free composition of this example provides satisfactory results in a detergency test.

EXAMPLE 2

Example 1 was repeated, except that the diamine was increased to 13.0 weight percent, the 60 percent active anionic surfactant was increased to 15.0 weight percent, and 5.0 weight percent of the water was replaced with 5.0 weight percent of isopropyl alcohol. A composition was obtained which yielded similar results when tested.

EXAMPLE 3

There was made a composition containing 10.0 percent of the above-indicated diamine, 10.0 percent of the above-indicated anionic surfactant, 11.0 percent of the first-indicated nonionic surfactant in Example 1, 27.5 percent of a nonionic surfactant based upon fatty alcohol containing 12 to 15 carbon atoms plus 9 moles of ethylene oxide, 6 weight percent of ethanol, and 35.5 percent of water. In testing, similar results were obtained.

EXAMPLE 4

There is made a liquid laundry detergent consisting essentially of 14.0 weight percent of N,N,N',N'-tetrakis(2-hydroxypropyl)ethylenediamine, 8.5 weight percent of an 85 percent-active linear sodium alkyl sulfonate, 10.0 weight percent of nonionic surfactant material based upon straight-chain alcohols containing 12 to 15 carbon atoms and oxyethylated to an average molecular weight of 350, 25.0 weight percent of nonionic surfactant material based upon straight-chain alcohols containing 12 to 15 carbon atoms, and oxyethylated to an average molecular weight of 600, and 42.5 weight percent of water.

EXAMPLE 5

There is made a liquid laundry detergent consisting essentially of 14.0 weight percent of N,N,N',N'-tetrakis(2-hydroxypropyl)ethylenediamine, 12.0 weight percent of a 65 percent active solution of N,N,N',N'-tetrakis(2-hydroxypropyl)ethylenediamine neutralized linear alkyl sulfonate, 10.0 weight percent of nonionic surfactant material based upon straight-chain alcohols containing 12 to 15 carbon atoms and oxyethylated to an average molecular weight of 350, 25.0 weight percent of nonionic surfactant material based upon straight-chain alcohols containing 12 to 15 carbon atoms, and oxyethylated to an average molecular weight of 600, and 39.0 weight percent of water.

EXAMPLE 6

Example 4 was duplicated except that 2.0 weight percent of the water was replaced with lauric acid.

EXAMPLE 7

Example 5 was duplicated except that 2.0 weight percent of the water was replaced with oleic acid.

The composition of Examples 4–7 were subjected to detergency testing by washing dacron/cotton fabric samples. A 0.15 weight percent of the compositions in tap water at 120° F. was tested. The results of such testing are given in the following Table.

| Detergency Evaluation Results | |
|---|---|
| Example | % Soil Removal |
| 4 | 55.0% |
| 5 | 59.82% |
| 6 | 66.5% |
| 7 | 63.10% |

These examples show that detergency can be improved by adding a fatty acid to the detergent formulation.

While I have shown and described herein certain embodiments of this invention, I intend to cover as well any changes or modifications which may be made without departing from its spirit and scope.

The embodiments of this invention in which an exclusive property or privilege is claimed are defined as follows:

1. A heavy-duty liquid detergent consisting essentially of:

(a) an alkalizing amount of 9 to 15 percent of a totally alkoxylated alkylene diamine based upon an initiator alkylene diamine containing 2 to 6 carbon atoms and alkoxylated with an alkylene oxide containing at least 2 carbon atoms, (b) 40 to 55 percent by weight of surfactants selected from the group consisting of nonionic, anionic, amphoteric, and zwitterionic surfactants, (c) 0.1 to 5 percent by weight of a fatty acid, and (d) 28 to 42 percent by weight of solvent.

2. A composition as defined in claim 1, wherein said totally alkoxylated alkylene diamine is N,N,N′,N′-tetrakis(2-hydroxypropyl)ethylenediamine.

3. A composition of claim 1 wherein said amount of fatty acid is from 1 weight percent to 2 weight percent.

4. A composition of claim 1 wherein the fatty acid is selected from the group consisting of oleic acid, decanoic acid, myristic acid, stearic acid, palmitic acid, lauric acid, isostearic acid, and mixtures thereof.

* * * * *